US005575268A

United States Patent [19]

Hirano et al.

[11] Patent Number: 5,575,268

[45] Date of Patent: Nov. 19, 1996

[54] AIR-FUEL RATIO CONTROLLING SYSTEM FOR INTERNAL COMBUSTION ENGINE

[75] Inventors: Kenichi Hirano, Iwanuma; Takashi Namari, Shibata-gun; Shinichi Nemoto, Kakuda, all of Japan

[73] Assignees: Kabushiki Kaisha Keihinseiki Seisakusho, Tokyo, Japan; Harley-Davidson, Inc., Milwaukee, Wis.

[21] Appl. No.: 562,193

[22] Filed: Nov. 22, 1995

[30] Foreign Application Priority Data

Nov. 24, 1994 [JP] Japan ..... 6-290163

[51] Int. Cl.[6] ..... F02D 41/00; F02M 23/00; F02M 25/00

[52] U.S. Cl. ..... 123/701

[58] Field of Search ..... 123/701

[56] References Cited

U.S. PATENT DOCUMENTS

| | | | |
|---|---|---|---|
| 4,217,314 | 8/1980 | Dysarz | 123/701 |
| 4,380,984 | 4/1983 | Nagai et al. | 123/701 |
| 4,417,558 | 11/1983 | Osuga et al. | 123/489 |
| 5,251,602 | 10/1993 | Kurihara et al. | 123/527 |
| 5,299,551 | 4/1994 | Tofel et al. | 123/701 |
| 5,309,889 | 5/1994 | Tofel et al. | 123/682 |
| 5,460,149 | 10/1995 | Tofel et al. | 123/676 |

FOREIGN PATENT DOCUMENTS

| | | |
|---|---|---|
| 57-91356 | 6/1982 | Japan . |
| 59-77065 | 5/1984 | Japan . |

*Primary Examiner*—Raymond A. Nelli
*Attorney, Agent, or Firm*—Nikaido, Marmelstein, Murray & Oram LLP

[57] ABSTRACT

An air-fuel ratio control system for an internal combustion engine including a carburetor having a main fuel system, a slow fuel system, a main bleed air passage leading to the main fuel system a main bleed air control passage leading to the main fuel system, a slow bleed air passage leading to the slow fuel system, and a slow bleed air control passage leading to the slow fuel system, and a valve for controlling the amount of bleed air supplied through the main and slow bleed air control passages. An electronic control unit controls the operation of the valve and is capable of carrying out a feed-back control for controlling the operation of the valve on the basis of a signal from the oxygen sensor so as to bring the air-fuel ratio into a theoretical value, and which determines a control value in such a manner that a feed-back control value is learned and stored to provide a learned value which is substantially constant with respect to fuel of a constant calorific value, and the stored learned value is reflected to a next control value. Thus, it is possible to perform a prompt and stable control of air-fuel ratio in accordance with a variation in calorific value of fuel and to stably and finely vary the amount of bleed air.

17 Claims, 15 Drawing Sheets

AIR-FUEL RATIO CONTROLLING SYSTEM FOR INTERNAL COMBUSTION ENGINE

TECHNICAL FIELD

The present invention relates to an air-fuel ratio control system for the carburetor of an internal combustion engine.

BACKGROUND ART

A conventional carburetor control system is shown in Japanese Patent Application Laid-open Nos.91356/82 and 77065/84, in which the amount of bleed air flowing through the main bleed air control passage and the slow air control passage is controlled by a solenoid valve to set the air-fuel ratio in the internal combustion engine to a value corresponding to the operational condition of the engine. However, this prior art system requires a fuel whose calorific value is substantially constant. Therefore, when operating the internal combustion engine using fuels having calorific values outside of the range, it is difficult to control the air-fuel ratio in conformity with the operational condition of the engine.

The present invention has been accomplished with such circumstance in view, and it is an object of the present invention to provide an air-fuel ratio control system for an internal combustion engine, wherein a plurality of types of fuel with different calorific values can be used, and the bleed air control quantity can be varied finely and stably to follow a variation in calorific value, thereby enabling a fine control of the air-fuel ratio.

DISCLOSURE OF THE INVENTION

To achieve the above object, according to the present invention, there is provided an air-fuel ratio control system for an internal combustion engine preferably including an oxygen sensor for detecting an oxygen component in an exhaust gas flowing through an exhaust passage. An electronic control unit is capable of carrying out a feed-back control for controlling the operation of a valve, such as a solenoid valve, on the basis of a signal from the oxygen sensor so as to bring the air-fuel ratio into a theoretical value. The control unit also determines a control value in such a manner that a feed-back control value is learned and stored to provide a learned value which is substantially constant with respect to fuel of a constant calorific value, and the stored learned value is reflected to a next control value.

With this arrangement, when a calorific value of a fuel is varied, it is possible to perform a prompt and stable control of the air-fuel ratio in such a manner that the variation in calorific value is judged by a substantially constant learned value provided by learning the feed-back control value. The result of such judgment is sent to the control value, making it possible to provide fine and stable variations in the amount of bleed air by controlling the value.

DETAILED DESCRIPTION

Figure 1:
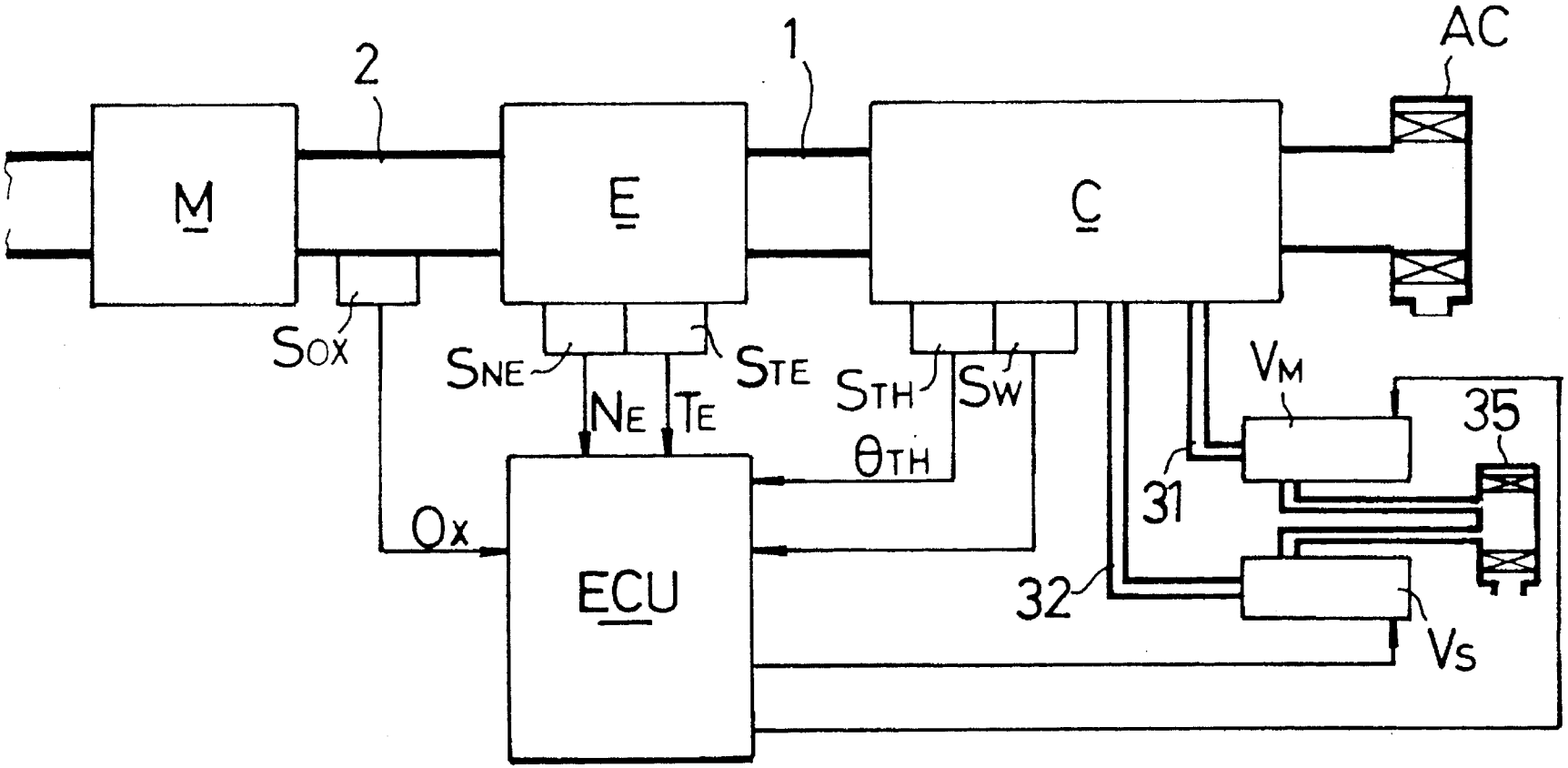
FIG. 1 is a schematic diagram illustrating an arrangement of a control system according to a preferred embodiment of the present invention.

Referring first to FIG. 1, many internal combustion engines, such as those used in certain motorcycles, have a carburetor to control the fuel-air mixture. As illustrated, the engine includes a carburetor C provided in the middle of an intake passage 1 connecting an air cleaner AC and an engine body E. A muffler M is provided in the middle of an exhaust passage 2 for guiding an exhaust gas from the engine body E.

The air-fuel ratio in this internal combustion engine is controlled by regulating the amount of bleed air in the carburetor C by a main solenoid valve $V_M$ and a slow solenoid valve $V_S$. A duty ratio of the main solenoid valve $V_M$ and the slow solenoid valve $V_S$ is controlled by an electronic control unit (ECU).

Figure 2:
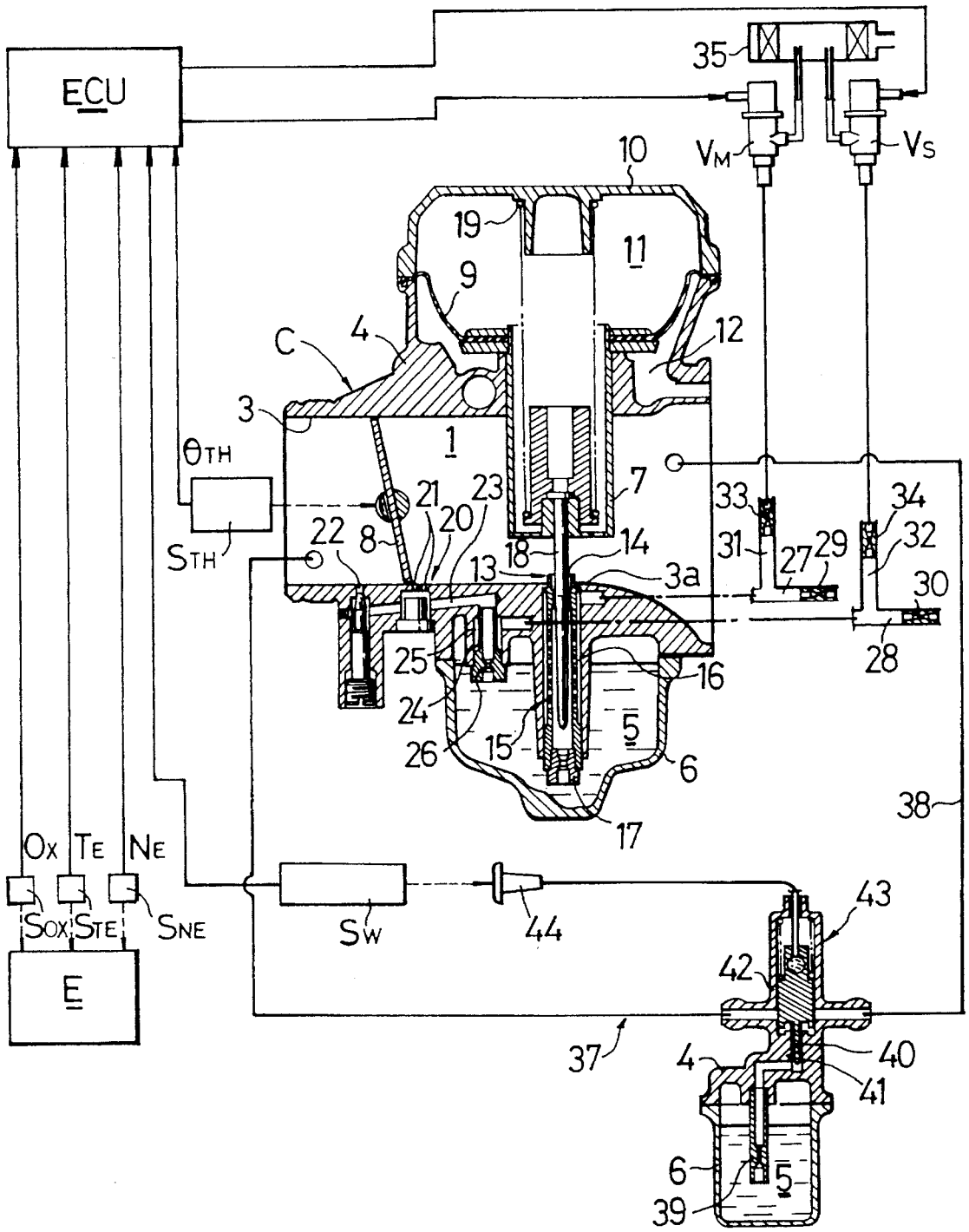
FIG. 2 is a vertical sectional view of a carburetor connected to the control system.

Referring to FIG. 2, the carburetor C is preferably of a variable venturi type. A carburetor body 4 is provided with an intake path 3 forming a portion of the intake passage 1. A float chamber body 6 is coupled to a lower portion of the carburetor body 4, thereby defining a float chamber 5 between the float chamber body 6 and the carburetor body 4. A fuel liquid is stored in the float chamber 5, such that a fuel liquid level is maintained constant by a float which is not shown.

A venturi portion 3*a* is provided in the middle of the intake path 3. A piston valve 7 for adjusting the opening area of the venturi portion 3*a* is accomplished by means of a slide which is received in an upper portion of the carburetor body 4 for vertical movement. A butterfly-shaped throttle valve 8 for adjusting the opening area of the intake path 3 rotates in the carburetor body 4 downstream from the venturi portion 3*a*. A cover 10 is coupled to an upper end of the carburetor body 4 to clamp an outer peripheral edge of a diaphragm 9 between the cover 10 and the carburetor body 4. The piston valve 7 is coupled at its upper end to a central portion of the diaphragm 9. A negative pressure chamber 11, into which a negative pressure (vacuum) in the venturi portion 3*a* is introduced, is defined between the cover 10 and the diaphragm 9. A return spring 19 is accommodated in the negative pressure chamber 11 for biasing the diaphragm 9 in a direction to increase the volume of the negative pressure chamber 11. An atmosphere-opened chamber 12 is defined between the carburetor body 4 and the diaphragm 9. When the negative pressure in the venturi portion 3*a* is increased, the diaphragm 9 is deflected in a direction to decrease the volume of the negative pressure chamber 11, and when the negative pressure in the venturi portion 3*a* is decreased, the diaphragm 9 is deflected in a direction to increase the volume of the negative pressure chamber 11. This ensures that the piston valve 7 is operated to always maintain the opening area of the venturi portion 3*a* substantially constant. At a lower movement limit of the piston valve 7, the venturi portion 3*a* is maintained at a predetermined opening degree.

A main fuel system 13 is provided in a lower portion of the carburetor body 4 and opens into the venturi portion 3*a*. The main fuel system 13 includes a main nozzle 14 which opens into the venturi portion 3*a*, and a bleed pipe 15 which is provided at its peripheral wall with a plurality of bleed bores and which is connected to and may be integrally formed with the main fuel nozzle 14. An annular chamber 16 is disposed between bleed pipe 15 and carburetor body 4 and cooperates with the bleed bores. A main fuel jet 17 opens below the fuel liquid level in the float chamber 5 and is connected to a lower end of the bleed pipe 15. A needle 18 is permanently retained at its upper end in the piston valve 7 and is inserted through the main nozzle 14 into the bleed pipe 15.

A slow fuel system 20 is provided at the lower portion of the carburetor body 4 and opens into the intake path 3 downstream from the venturi portion 3*a*. The slow fuel system 20 includes a bypass port 21 which opens into the intake path 3 in the vicinity of the throttle valve 8. An idle port 22 opens into the intake path 3 downstream from the throttle valve 8. A fuel passage 23 provided in the carburetor body 4 leads commonly to the bypass port 21 and the idle port 22. A bleed pipe 24 includes a plurality of bleed bores at its peripheral wall and extends into the fuel passage 23. An annular chamber 25 is disposed between bleed pipe 24 and carburetor body 4 to permit the bleed bores to commonly lead to the fuel passage 23. A slow fuel jet 26 is connected to and may be integrally formed with a lower end of the bleed pipe 24 and is open below the fuel liquid level in the float chamber 5.

The carburetor body 4 is further provided with a main bleed air passage 27 which permits communication between a portion of the intake path 3 upstream of the venturi portion 3*a* and the annular chamber 16 in the main fuel system 13, and a slow bleed air passage 28 which permits the communication between a portion of the intake path 3 upstream of the venturi portion 3*a* and the annular chamber 25 in the slow fuel system 20, is mounted at an upstream end of the main bleed air passage 27. A second stationary jet 30 is mounted at an upstream end of the slow bleed air passage 28. A main bleed air control passage 31 is diverged from the main bleed air passage 27 at a location downstream from the first stationary jet 29 and is connected at its upstream end to the main solenoid valve $V_M$. A slow bleed air control passage 32 is diverged from the slow bleed air passage 28 at a location downstream from the second stationary jet 30 and connected at its upstream end to the slow solenoid valve $V_S$. Moreover, a third stationary jet 33 is incorporated in the middle of the main bleed air control passage 31, and a fourth stationary jet 34 is incorporated in the middle of the slow bleed air control passage 32.

In this manner, the main bleed air passage 27 is opened into the intake passage 1 through the first stationary jet 29; the slow bleed air passage 28 is opened into the intake passage 1 through the second stationary jet 30; the main bleed air control passage 31 is diverged from the main bleed air passage 27 at the location downstream from the first stationary jet 29; and the slow bleed air control passage 32 is diverged from the slow bleed air passage 28 at the location downstream from the second stationary jet 30. Therefore, it is possible to moderate the pulsation applied to the bleed air supplied to the main fuel system 13 and the slow fuel system 20 with the opening and closing operations of the main solenoid valve $V_M$ and the slow solenoid valve $V_S$. Moreover, the incorporation of the third stationary jet 33 in the main bleed air control passage 31 and the fourth stationary jet 34 in the slow bleed air control passage 32 eliminates the necessity to specially set the passage diameters of the main bleed air control passage 31 and the slow bleed air control passage 32, thereby facilitating the setting of the passage diameters.

Inlet ports in the main solenoid valve $V_M$ and the slow solenoid valve $V_S$ are preferably independently connected to an auxiliary air cleaner 35 other than the air cleaner AC at the upstream end of the intake passage 1 to communicate with the atmosphere through the auxiliary air cleaner 35. Thus, it is possible to dampen within the auxiliary air cleaner 35, the intake pulsation transmitted through the main bleed air control passage 31 and the slow bleed air control passage 32, and to eliminate the interference of the intake pulsation with the amount of air controlled in the solenoid valves $V_M$ and $V_S$. More specifically, when the opening degree of the throttle valve 8 is small, a negative pressure applied to the slow bleed air control passage 32 is larger than a negative pressure applied to the main bleed air control passage 31. On the other hand, when the opening degree of the throttle valve 8 is large, the negative pressure applied to the main bleed air control passage 31 is larger than the negative pressure applied to the slow bleed air control passage 32. If the inlet ports of the main and slow solenoid valves $V_M$ and $V_S$ are connected by teeing together before connecting to the auxiliary air cleaner 35, an interference due to the above-described difference in pressure is generated. But such interference can be prevented from being generated by independently connecting the inlet ports of the main and slow solenoid valves $V_M$ and $V_S$ to the auxiliary air cleaner 35.

To control the bleed air amount in correspondence to a plurality of types of fuels having different calorific values in a wider range, it is necessary to set the orifice diameter of the third stationary jet 33 in the main bleed air control passage 31 and the orifice diameter of the fourth stationary jet 34 in the slow bleed air control passage 32 at relatively large values, and to set the orifice diameter of the first stationary jet 29 in the main bleed air passage 27 and the orifice diameter of the second stationary jet 30 in the slow bleed air passage 28 at relatively small values. However, if the orifice diameters of the first and second stationary jets 29 and 30 are too small, the bleed air amount may be insufficient to atomize the fuel when the solenoid valves $V_M$ and $V_S$ are in their fully opened states. On the other hand, if the orifice diameters of the third and fourth stationary jets 33 and 34 are too large, the correlation cannot be achieved between the duty control of the solenoid valves $V_M$ and $V_S$ and the supply flow rate, resulting in the control being difficult. Therefore, to ensure a sufficient amount of bleed air when the solenoid valves $V_M$ and $V_S$ are in their fully closed states and to ensure a correlation between the duty control of the solenoid valves $V_M$ and $V_S$ and the supply flow rate, the orifice diameter of each of the first and second stationary jets 29 and 30 is set at a relatively small value (e.g., at least 0.3 mm), and the orifice diameter of each of the third and fourth stationary jets 33 and 34 is set at a relatively large value (e.g., at most 1.8 mm).

The carburetor C is provided with a bypass starter 37. The bypass starter 37 includes a bypass passage 38 connecting a portion of the intake path 3 upstream of the venturi portion 3*a* and a portion of the intake path 3 downstream from the throttle valve 8. Bypass starter 37 also includes a starting fuel nozzle 40 communicating with the inside of the float chamber 5 through the fuel jet 39 and opening into an intermediate portion of the bypass passage 38. A starting valve 43 having a valve member 43 and a needle 42 inserted into the nozzle 40 is capable of opening and closing the intermediate portion of the bypass passage 38. The starting valve 43 is opened and closed by manually operating an operating knob 44.

Through bypass starter 37, a cranking negative pressure in the engine can be introduced into the bypass passage 38 by opening the starting valve 43 while maintaining the closed position of the throttle valve 8 at the start of the engine at a low temperature. This permits the formation of a rich mixture of air flowing through the bypass passage and fuel being injected from the starting fuel nozzle 40 to supply the engine.

The opening degree ($\theta_{TH}$) of the throttle valve 8 in the carburetor C is detected by a throttle sensor $S_{TH}$ (e.g., potentiometer). The operation and non-operation of the bypass starter 37 (i.e., whether or not the operating knob 44 has been operated) is detected by a switch $S_W$ whose switching mode is changed in accordance with whether or not the operating knob 44 has been operated. The engine speed $N_E$ (r.p.m.) in the engine body E is detected by a speed sensor $S_{NE}$. The engine temperature $T_E$ of the engine body E is detected by a temperature sensor $S_{TE}$. The oxygen component in the exhaust gas flowing through the exhaust passage 2 is detected by an oxygen sensor $S_{OX}$ (e.g., a zirconia oxygen sensor). Signals from these sensors $S_{TH}$, $S_{NE}$, $S_{TE}$ and $S_{OX}$ and the switch $S_W$ are supplied to the electronic control unit ECU, and this control unit ECU duty-controls the main and slow solenoid valves $V_M$ and $V_S$ on the basis of these signals.

In duty-controlling the main and slow solenoid valves $V_M$ and $V_S$, it is desirable that the opening and closing frequency is relatively low in order to make the range of usable control values relatively wide. For this purpose, the opening and closing frequency is set at a value in the range of 5 to 20 Hz, desirably at a value on the order of 10 Hz.

Figure 3:
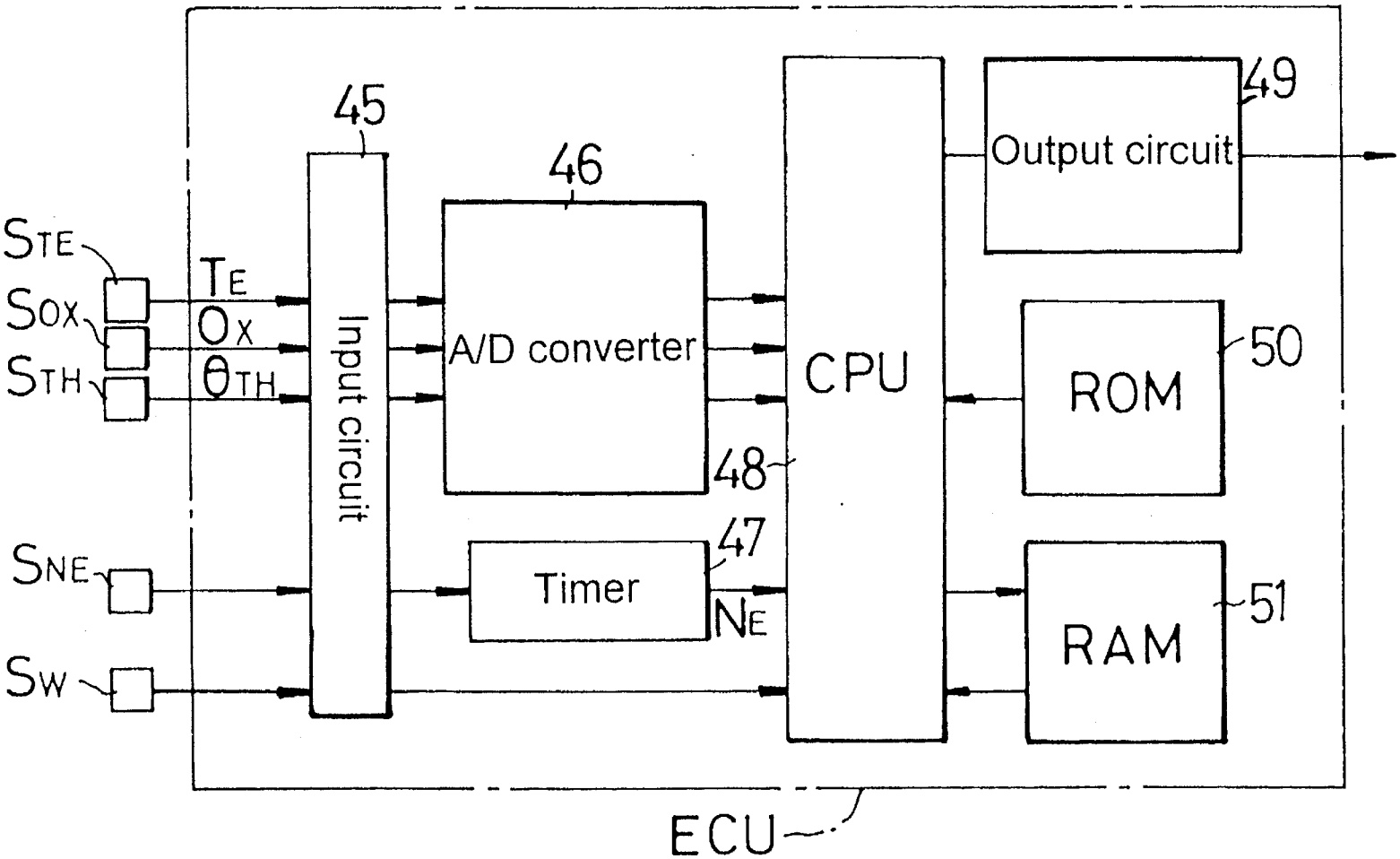
FIG. 3 is a block diagram illustrating an arrangement of an electronic control unit.

Referring to FIG. 3, the electronic control unit ECU includes an input circuit 45, an A/D converter 46, a timer 47, a central processing circuit (CPU) 48, an output circuit 49, a read-only memory (ROM) 50 and a random access memory (RAM) 51. The engine temperature $T_E$ is detected by the temperature sensor $S_{TE}$. The signal $O_X$ is indicative of the presence or absence of the oxygen component and is determined in the oxygen sensor $S_{OX}$. The throttle opening degree $\theta_{TH}$ is determined in the throttle sensor $S_{TH}$. These signals are preferably analog signals and are inputted through the input circuit 45 into the A/D converter 46. Circuit 45 provides filtering to the signals. There, these signals are converted into digital signals which are then inputted to the CPU 48. The engine speed $N_E$ is detected by the speed sensor $S_{NE}$ (e.g., magnetic pick-up arrangement) and is a pulse signal inputted through the input circuit 45 into the timer 47. A period is calculated in the timer 47 and is inputted into the CPU 48. An on/off signal is inputted from the switch $S_W$ into the CPU 48 through the input circuit 45. Thus, in the CPU 48, a control calculation is carried out according to a programmed procedure (which will be described in detail later) established in the ROM 50 based on the received signals. According to the result of such calculation, a driving signal is outputted from the output circuit 49 to the main and slow solenoid valves $V_M$ and $V_S$. The RAM 51 stores necessary data and results of calculation determined in the control calculation in the CPU 48 in a writable manner.

The procedure for controlling the opening and closing of the main and slow solenoid valves $V_M$ and $V_S$ will be described below with reference to FIGS. 4 to 20.

Figure 4:
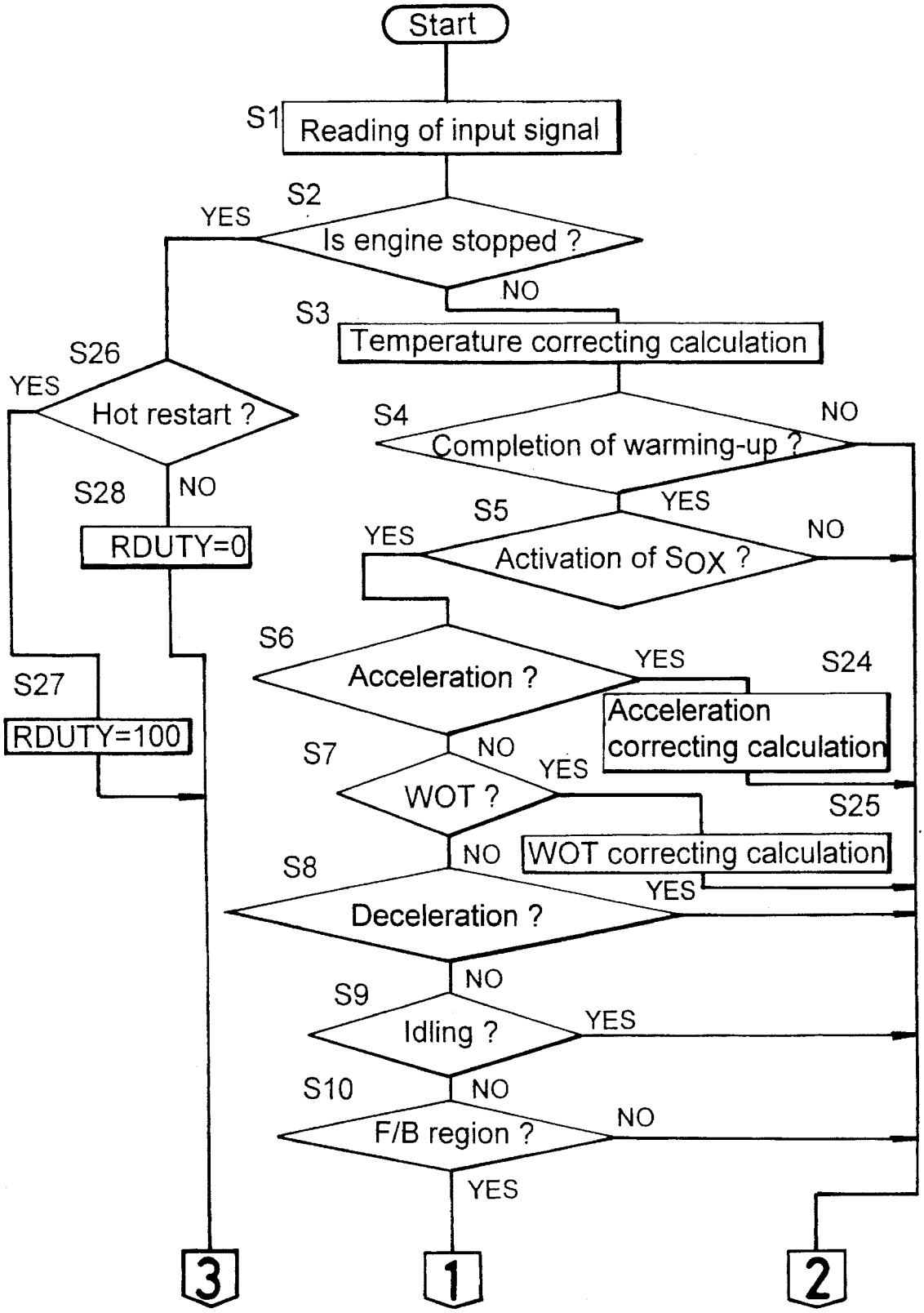
FIG. 4 is a flow chart illustrating a portion of a main routine for controlling the air-fuel ratio.
Figure 5:
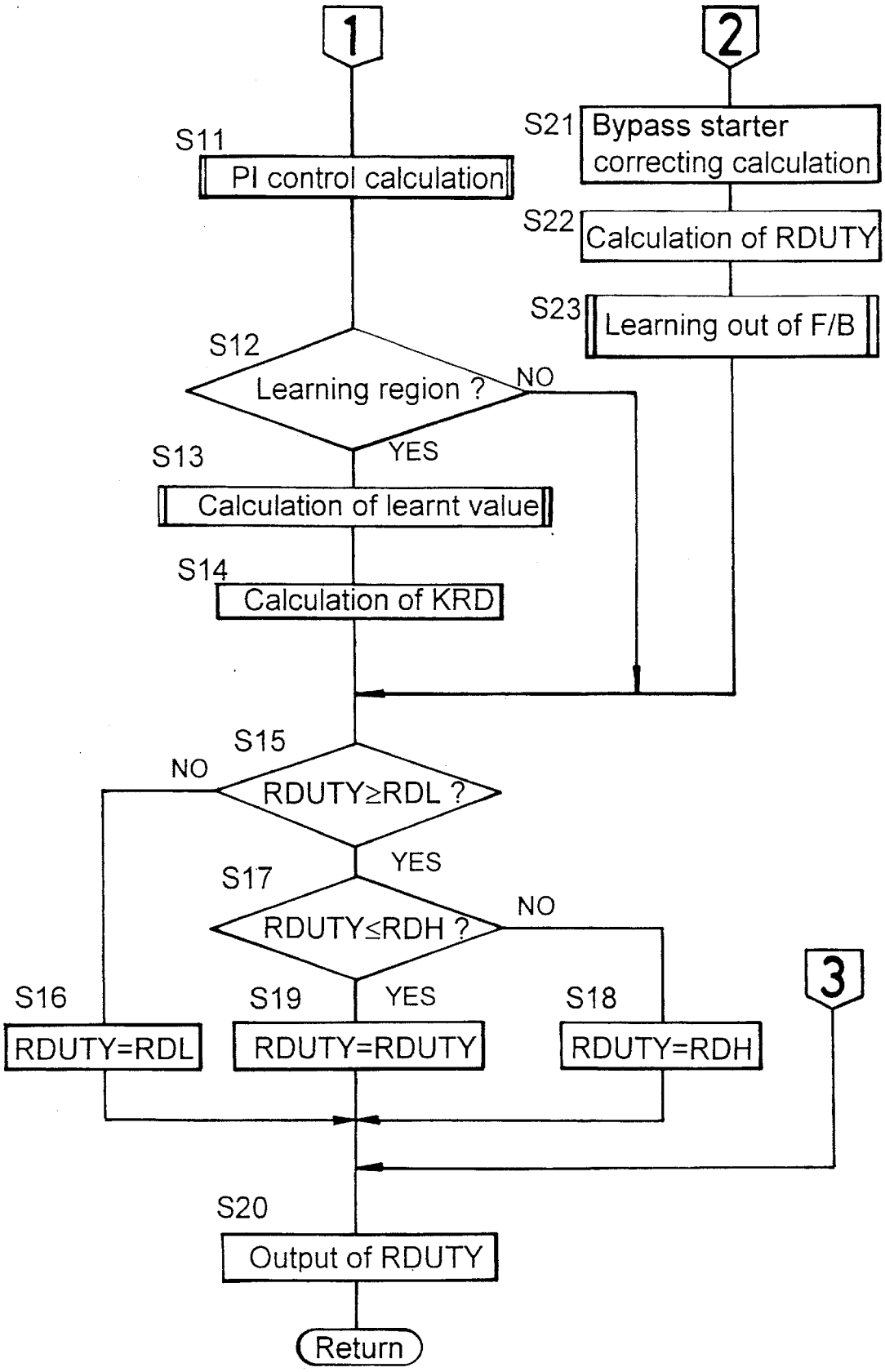
FIG. 5 is a flow chart illustrating the remaining portion of the main routine for controlling the air-fuel ratio.

First, in a main routine shown in FIGS. 4 and 5, a signal received from the input circuit 45, the A/D converter 46, and the timer 47 is read at step S1, and it is judged at step S2 whether or not the engine is in its stopped state. If it has been decided that the engine is not in its stopped state, a temperature-correcting calculation is carried out at step S3.

At steps S4–S10, it is judged whether the warm-up of the engine has been completed, whether the oxygen sensor $S_{OX}$ for detecting the oxygen component $O_X$ has been activated, whether the engine is in its accelerating state, whether the opening degree $\theta_{TH}$ is in its widely-opened (WOT) state, whether the engine is in its decelerating state, and whether the operational condition of the engine is in a feed-back control region, respectively.

If it has been decided at steps S4–S10 that the warm-up of the engine has been completed, the oxygen sensor $S_{OX}$ for detecting the oxygen component $O_X$ has been activated, the engine is in its non-accelerating state, the throttle valve 8 is not in its widely-opened state, the engine is not in its decelerating state, nor in its idling state, and the operational condition of the engine is in the feed-back control region, respectively, the processing is advanced to step S11 shown in FIG. 5.

At step S11 in FIG. 5, a proportional-integral (PI) control calculation for the feed-back control is carried out, and at step S12, it is judged whether the operational condition of the engine is in a learning region. If it is decided that the operational condition of the engine is in the learning region, the calculation of a learned value RREF is carried out at step S13 and then, the calculation of a correcting term KRD dependent upon the learned value is carried out at step S14. From step S15 to step S19, a limit check for duty control value RDUTY is carried out, and thereafter, at step S20, a duty control value RDUTY is outputted, thereby permitting the duty ratio between the main and slow solenoid valves $V_M$ and $V_S$ to be controlled.

If it has been decided at step S4 shown in FIG. 4 that the engine warm-up is still not completed, the processing is advanced to step S21 shown in FIG. 5. If it has been decided at step S5 that the oxygen sensor $S_{OX}$ is in its inactivated state, the processing is advanced to step S21. If it has been decided at step S6 that the engine is in its accelerating state, an acceleration correcting term DRACC is calculated at step S24, progressing to step S21. If it has been decided at step S7 that the throttle valve 8 is its wide-open-throttle (WOT) state, a WOT correcting term DRWOT is calculated at step S25, progressing to step S21. If it has been decided that the engine is in its decelerating state at step S8, that the engine is in its idling state at step S9, and that the operational condition of the engine is out of its feed-back control region at step S10, the processing advanced to step S21.

At step S21 in FIG. 5, a bypass starter correcting term DRBS dependent upon the non-operation and operation of the bypass starter 37 is calculated. At step S22, a duty control value RDUTY in an open-loop control is calculated. At step S23, a learned value RREF in the open-loop control out of the feed-back control region is calculated, and then the sequence progresses to step S15.

If it has been decided at step S2 shown in FIG. 4 that the engine is in its stopped state, the processing is advanced from step S2 to step S26, where it is judged whether or not the engine has been restarted in a hot state. If it is decided that the engine has been restarted in the hot state, the duty control value RDUTY is set at 100% at step S27, progressing to step S20 shown in FIG. 5. If it is decided that the restarting of the engine is not in the hot state, the duty control value RDUTY is set at 0% at step S28, progressing to step S20 shown in FIG. 5.

Figure 6:
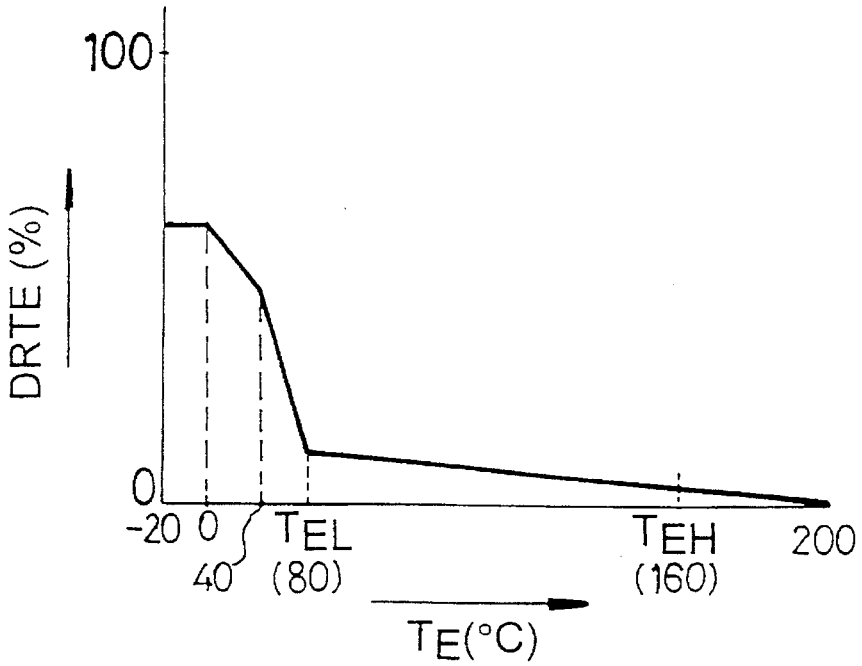
FIG. 6 is a graph illustrating a calculation value of a correcting term with respect to the engine temperature.

The temperature correcting term DRTE is previously established as shown in FIG. 6 depending upon the engine temperature $T_E$. At step S3, the temperature correcting term DRTE is calculated in an interpolating manner on the basis of a look-up table thereof. As shown in FIG. 6, in a temperature range from a lower temperature $T_{EL}$ (e.g., 80°) to a higher temperature $T_{EH}$ (e.g., 160°) in a normal operational condition of the engine, the temperature correcting term DRTE is gradually reduced, as the temperature is increased. In a range lower than the lower temperature $T_{EL}$, the temperature correcting term DRTE is steeply and stepwise reduced, as the temperature is increased.

Figure 7:
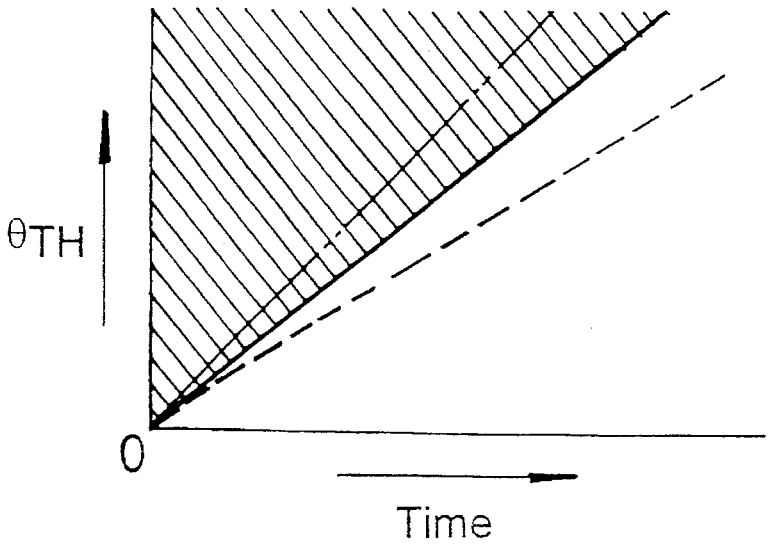
FIG. 7 is a diagram illustrating a map for judgment of an acceleration.
Figure 8:
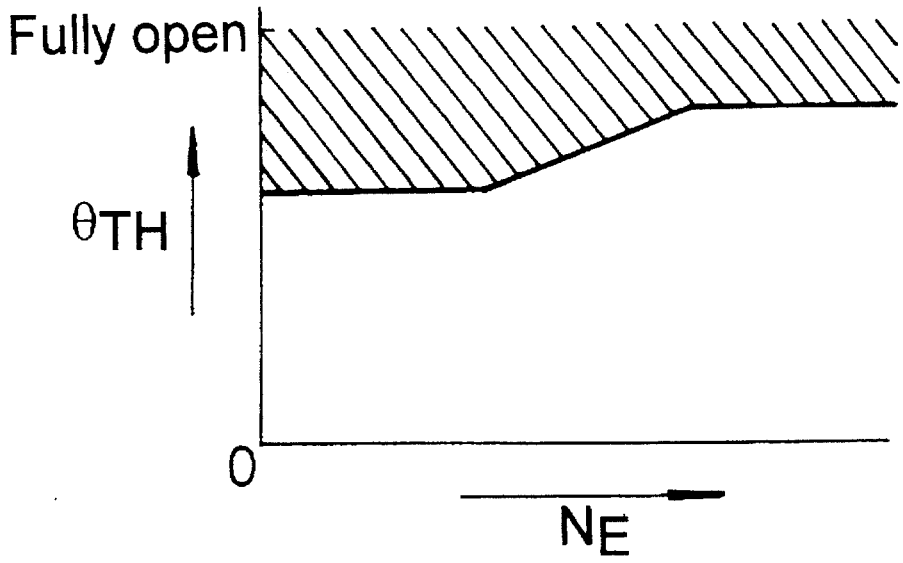
FIG. 8 is a diagram illustrating a map for judgment of a wide-open-throttle (WOT) state of a throttle valve.
Figure 9:
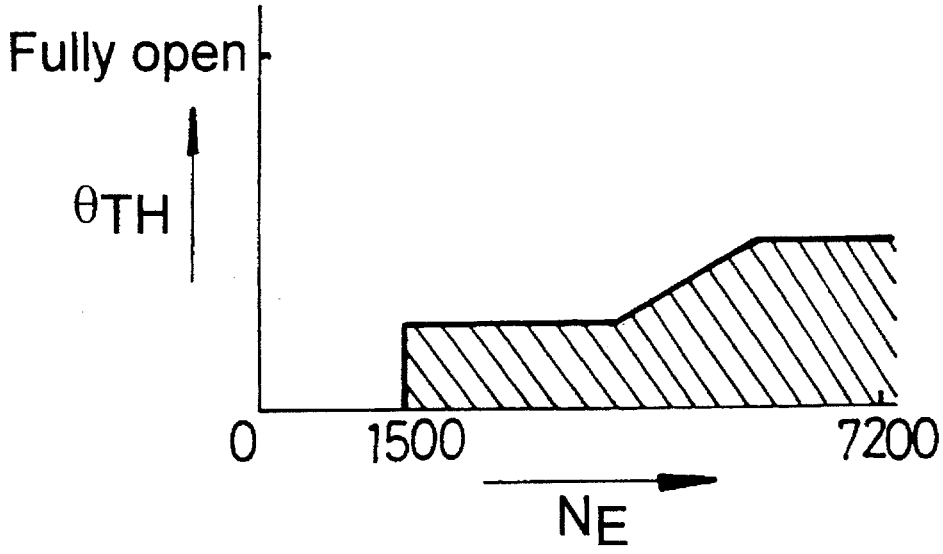
FIG. 9 is a diagram illustrating a map for judgment of a deceleration.
Figure 10:
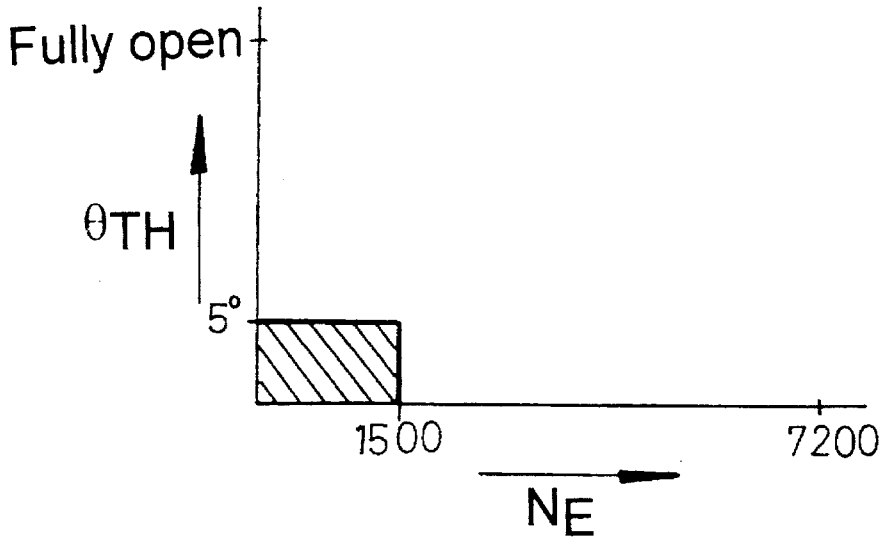
FIG. 10 is a diagram illustrating a map for judgment of an idling operation.

At step S6, it is judged whether the engine is in its accelerating state. In this judgment, a criterion is established as shown in FIG. 7. More specifically, if the throttle opening degree $\theta_{TH}$ is varied in an obliquely lined range shown in FIG. 7 with a lapse of time as shown by a dashed line, it is decided that the amount of throttle opening degree $\theta_{TH}$ varied per unit time is large and the engine is in the accelerating state. If the throttle opening degree $\theta_{TH}$ is varied in a range other than the obliquely lined range shown in FIG. 7 with a lapse of time as shown by a dashed line, it is decided that the amount of throttle opening degree $\theta_{TH}$ varied per unit time is small and the engine is in its non-accelerating state. At step S7, it is judged whether the throttle opening degree $\theta_{TH}$ is in a WOT state. In this judgment, it is judged whether the throttle opening degree $\theta_{TH}$ is larger than a value given from the look-up table previously established depending upon the engine speed $N_E$, i.e., whether the throttle opening degree $\theta_{TH}$ is in an obliquely lined range shown in FIG. 8. At step S8, it is judged whether the engine is in its decelerating state. In this judgment, it is judged whether the throttle opening degree $\theta_{TH}$ is larger than the value given from the look-up table previously established depending upon the engine speed $N_E$ in a condition in which the engine speed $N_E$ is equal to or larger than a predetermined value (e.g., 1,500 rpm), i.e., whether the throttle opening degree $\theta_{TH}$ is in an obliquely lined range shown in FIG. 9. At step S9, it is judged whether the engine is in an idling state. In this judgment, it is judged whether the throttle opening degree $\theta_{TH}$ is equal to or smaller than a predetermined value in a condition in which the engine speed $N_E$ is smaller than the predetermine value (e.g., 1,500 rpm), i.e., whether the throttle opening degree $\theta_{TH}$ is in an obliquely lined range shown in FIG. 10. Further, at step S10, it is judged whether the operational state of the engine is in a feedback control range. This judgment is made on the basis of a look-up table in which upper and lower limit values for the throttle opening degree $\theta_{TH}$ have been predetermined depending upon the engine speed $N_E$, in a condition in which the engine speed $N_E$ is a value between predetermined upper and lower limit values. In other words, it is judged at step S10 whether the throttle opening degree $\theta_{TH}$ is present in an obliquely lined range shown in FIG. 11.

Figure 12:
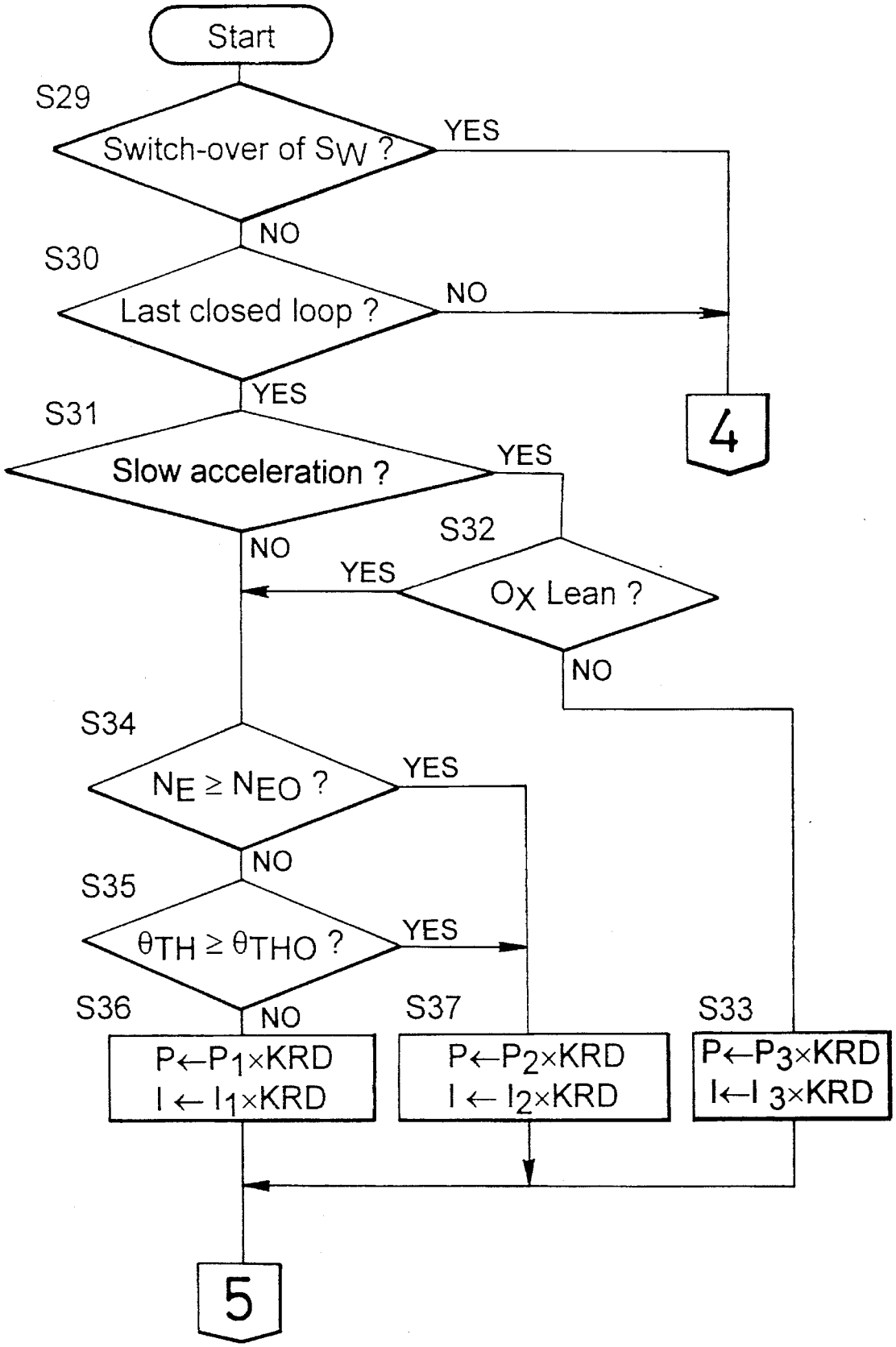
FIG. 12 is a flow chart illustrating a portion of a sub-routine for carrying out a proportional-integral (PI) control calculation during a feed-back control.
Figure 13:
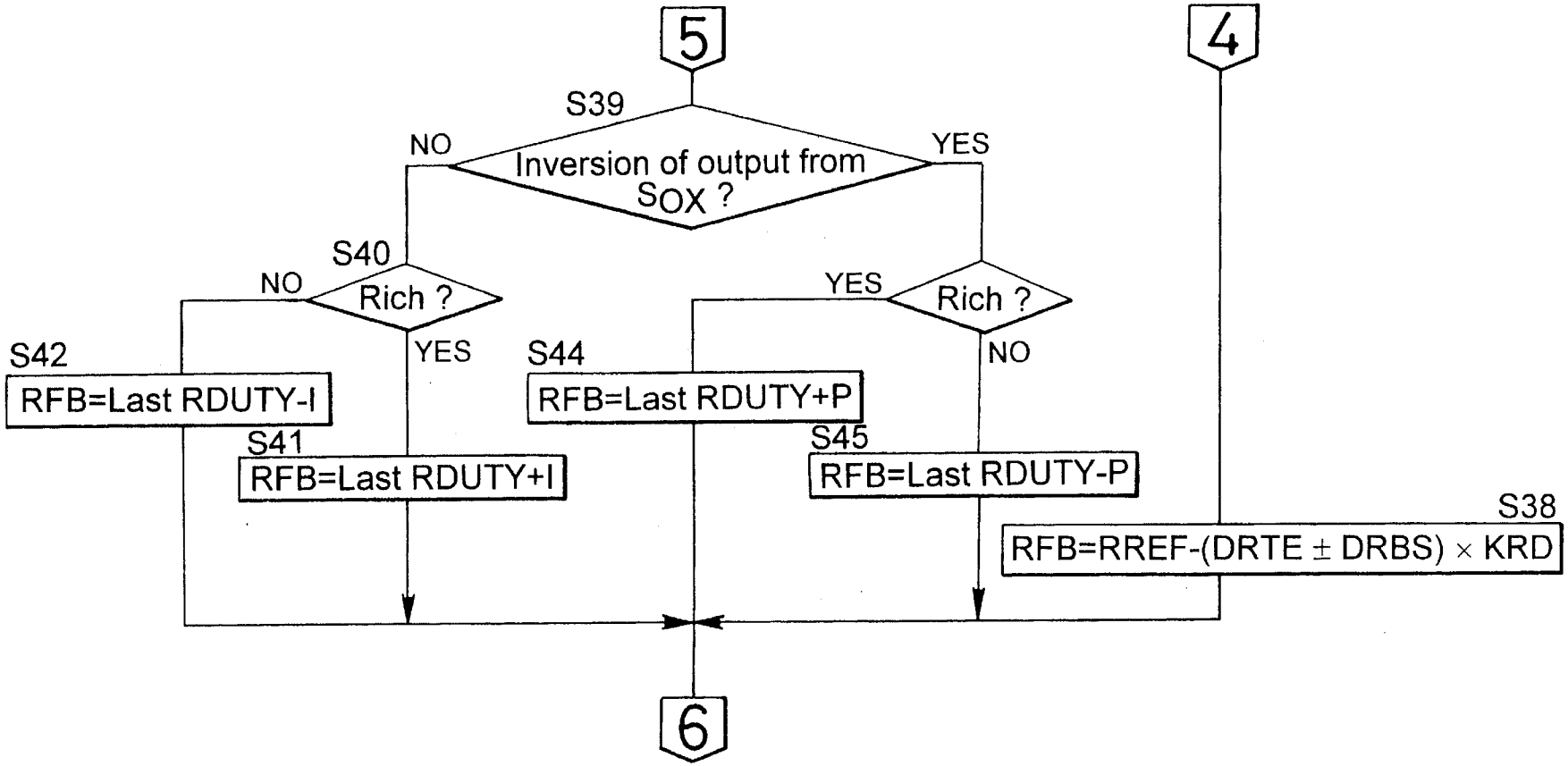
FIG. 13 is a flow chart illustrating another portion of the sub-routine for carrying out a proportional-integral (PI) control calculation during a feed-back control.
Figure 14:
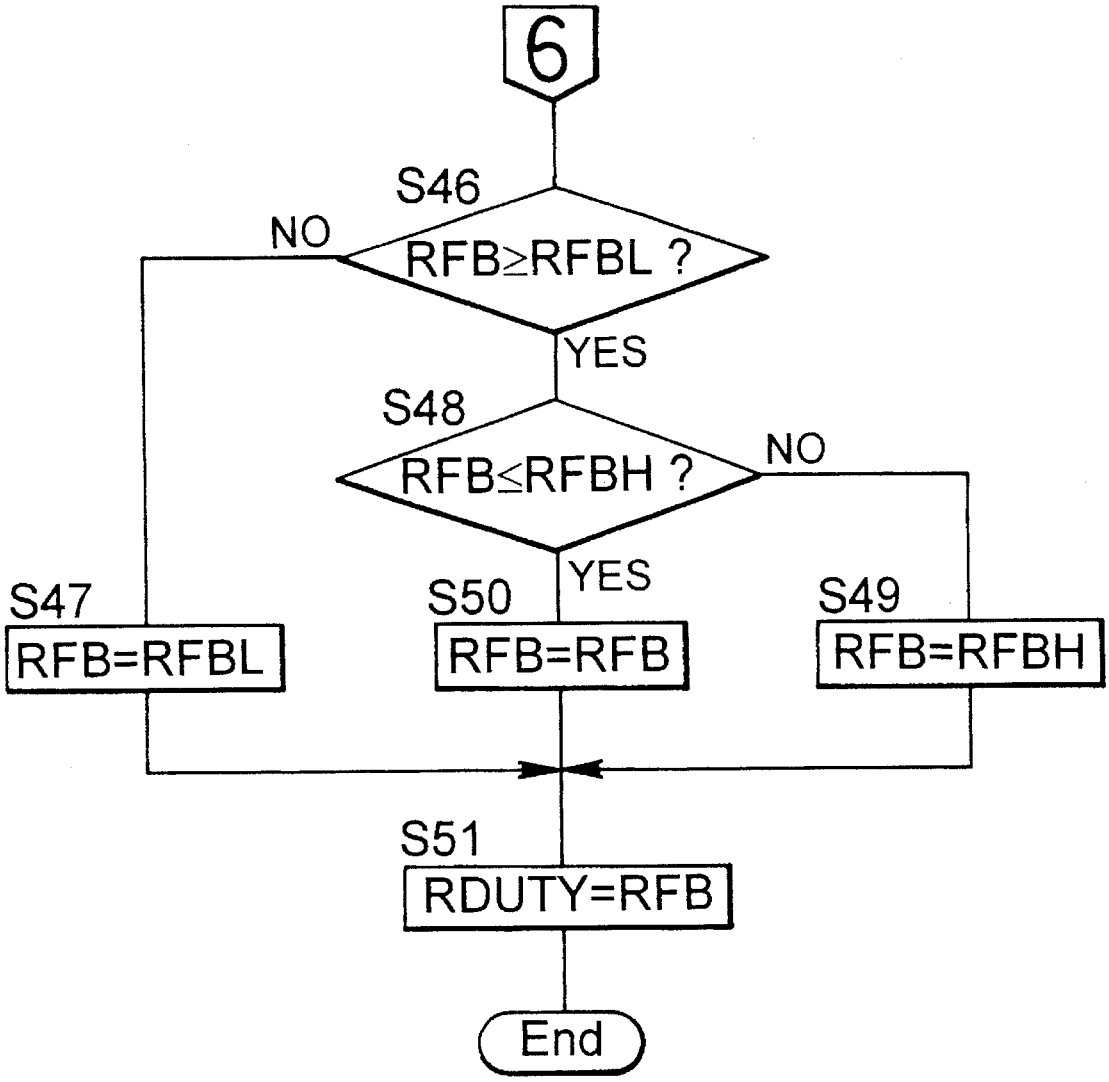
FIG. 14 is a flow chart illustrating the remaining portion of the sub-routine for carrying out a proportional-integral (PI) control calculation during a feed-back control.

At step S11, the PI control calculation is carried out according to a sub-routine shown in FIGS. 12 to 14. At step S29 shown in FIG. 12, it is judged whether the output signal from the switch $S_W$ has been changed over. In other words, it is judged at step S29 whether the bypass starter 37 has been switched over from its non-operative state to its operative state, as well as whether the bypass starter 37 has been switched over from its operative state to its non-operative state. If it is decided that the bypass starter 37 is not switched over, it is judged at step S30 whether there is a closed-loop control, i.e., whether the feed-back control was carried out last time. If it is decided that the feed-back control was carried out last time, the processing is advanced to step S31.

It is judged at step S31 whether the engine is in its slowly accelerating state. If it is decided at step S31 that the engine is in its slowly accelerating state, it is judged at step S32 whether the output signal $O_X$ from the oxygen sensor $S_{OX}$ indicates a lean condition. If it is decided that the output signal $O_X$ from the oxygen sensor $S_{OX}$ indicates a rich condition, a P term and an I term are set at values obtained by multiplying the fixed values $P_3$ and $I_3$ by KRD, respectively, at step S33.

If it is decided at step S31 that the engine is not in its slowly accelerating state, and if it is decided at step S32 that the engine is in its slowly accelerating state but in the lean condition, then the processing is advanced to step S34. Here, it is judged whether the engine speed $N_E$ is equal to or more than a preset speed $N_{E0}$ ($N_E \geqq N_{EO}$). If $N_E < N_{E0}$, it is judged at step S35 whether the throttle opening degree $\theta_{TH}$ is equal to or more than a preset value $\theta_{TH0}$ ($\theta_{TH} \geqq \theta_{TH0}$). If $N_E < N_{E0}$ and $\theta_{TH} < \theta_{TH0}$, the P term is determined as ($P_1 \times$KRD), and the I term is determined as ($I_1 \times$KRD) at step S36. If $N_E \geqq N_{E0}$ or $\theta_{TH} \geqq \theta_{TH0}$, the P term is determined as ($P_2 \times$KRD), and the I term is determined as ($I_2 \times$KRD) at step S37. In the above expressions, each of $P_1$, $P_2$, $I_1$ and $I_2$ is a fixed value, with the proviso that $P_3 < P_1$ or $P_2$, and $I_3 < I_1$ or $I_2$.

In the rich condition in the slowly accelerating state, the P and I terms are determined smaller than those in the feed-back control during a time other than during slow acceleration, whereby the variation in the feed-back control value is determined at a small value.

If it is decided at step S29 that the output signal from the switch $S_W$ has been changed over, as well as if it is decided at step S30 that the open-loop control has been conducted the previous time in a condition in which the output signal from the switch $S_W$ is not changed over, the processing is advanced to step S38 shown in FIG. 13. After completion of the determination of the P and I terms at steps S33, S36 and S37, the processing is advanced to step S39 shown in FIG. 13.

At step S38 in FIG. 13, a feed-back control value RFB is initialized. In other words, the feed-back control value RFB is established as RFB=RREF−(DRTE±DRBS)×KRD. Here, the bypass starter correcting term DRBS is determined at step S21 (see FIG. 15) and has a "minus" sign during operation of the bypass starter 37 to correct the feed-back control value RFB toward a lean side, and a "plus" sign during non-operation of the bypass starter 37 to correct the feed-back control value RFB toward a rich side.

At step S39, it is judged whether the output from the oxygen sensor $S_{OX}$ has been inverted, i.e., output has been inverted from the lean side value to the rich-side value, or from the rich side to the lean side. If it is decided that the output from the oxygen sensor $S_{OX}$ is not inverted, it is judged at step S40 whether or not the output from the oxygen sensor $S_{OX}$ indicates a rich condition. If it is decided that the output indicates the rich condition, the feed-back control value RFB is determined as "the last duty control value RDUTY+I term" at step S41 for controlling thereof toward the lean side. On the other hand, if it is decided that the output indicates the lean condition, the feed-back control value RFB is determined as "the last duty control value RDUTY−I=term" at step S42 for controlling thereof toward the rich side.

If it is decided at step S39 that the output from the oxygen sensor $S_{OX}$ has been inverted, it is judged at step S43 whether the output has been inverted from the lean side to the rich side. If it is decided yes, the feed-back control value RFB is determined as "the last duty control value RDUTY+P term" at step S44 for controlling toward the lean side. If it is decided that the output has been inverted from the rich side to the lean side, the feed-back control value RFB is determined as "the last duty control value RDUTY−P term" at step S45 for controlling the enriching value.

After completion of steps S38, S41, S42, S44 and S45, the processing is advanced to step S46. At step S46 through S50, a limit check for the feed-back control value RFB is carried out. If the feed-back control value RFB is smaller than a lower limit value RFBL, it is determined as RFB=RFBL at step S47. If the feed-back control value RFB exceeds an upper limit value RFBH, it is determined as RFB=RFBH at step S49. If the feed-back control value RFB is equal to or more than the lower limit value RFBL and equal to or less than the upper limit value RFBH, it is determined as RFB=RFB at step S50. At step S51, the duty control value RDUTY is determined as RDUTY=RFB.

Figure 11:
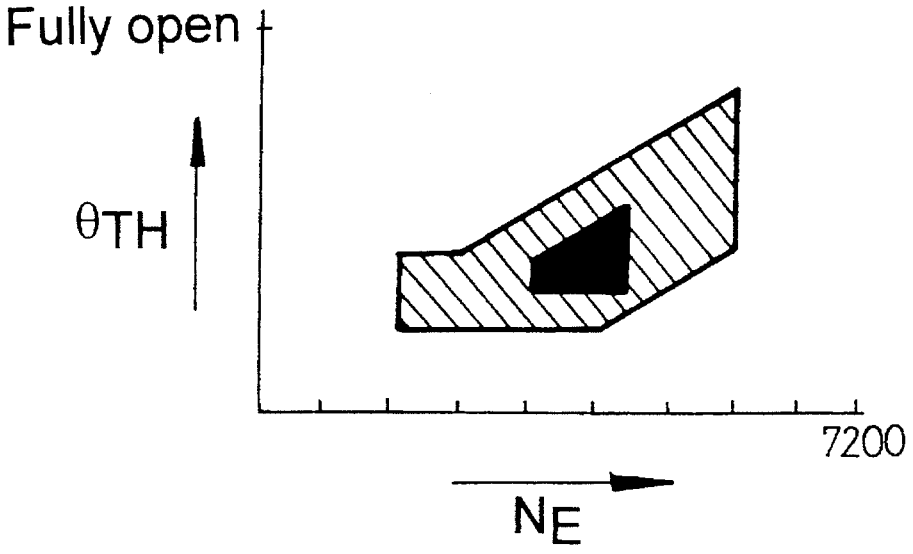
FIG. 11 is a diagram illustrating a map for judgment of a feed-back control region and a map of learning region.

At step S12 (see FIG. 5) after execution of the PI control calculation, it is judged whether or not the operational condition of the engine is in the learning region on the basis of whether or not a point determined by the engine speed $N_E$ and the throttle opening degree $\theta_{TH}$ is in a blackened-out region as shown in FIG. 11. If it is decided that the operational condition of the engine is not in the learning region, the last learned value RREF is retained as it is, progressing to step S15. If it is decided that the operational condition of the engine is in the learning region, the calculation of the learned value is carried out at step S13.

Figure 15:
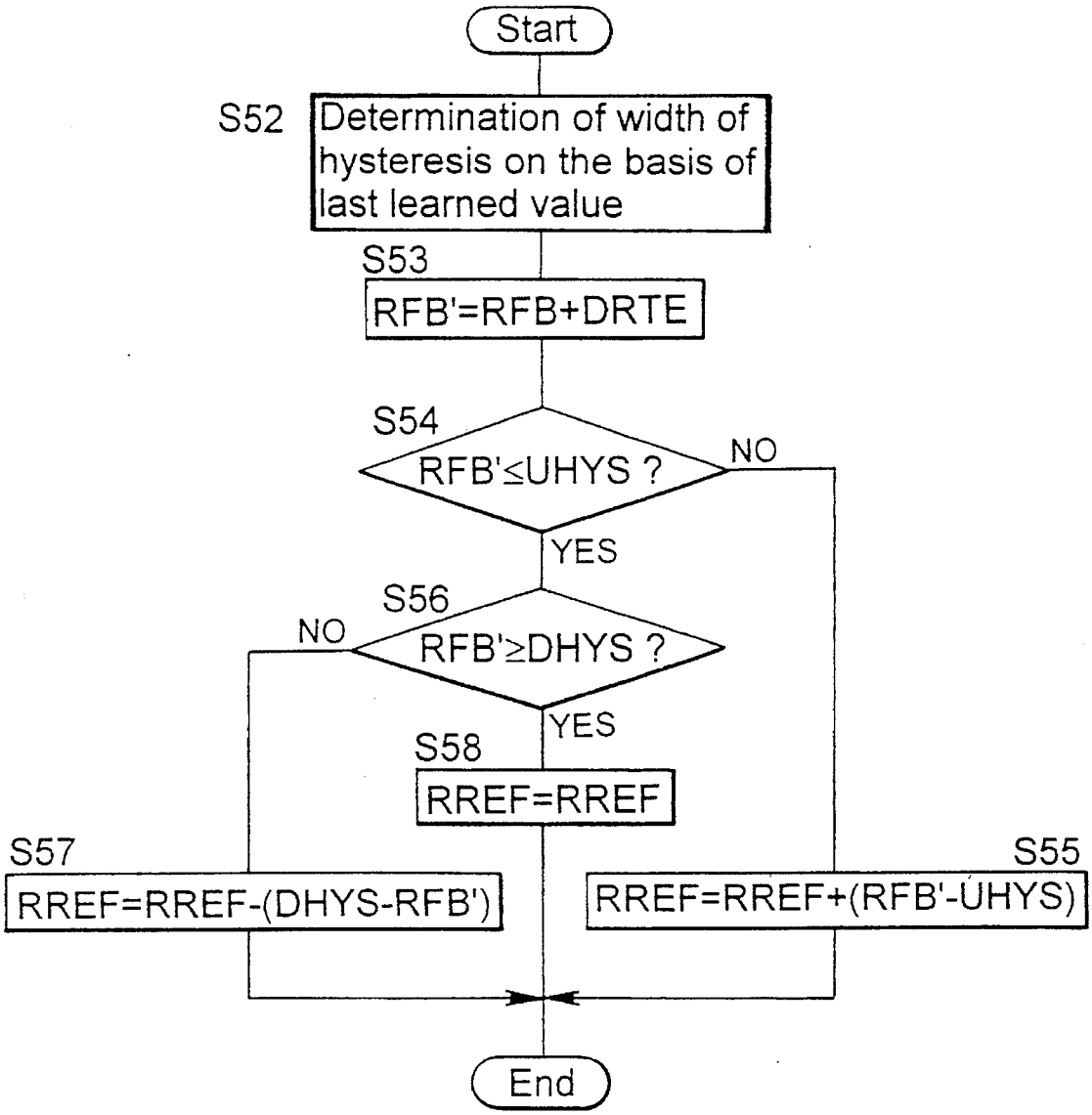
FIG. 15 is a flow chart illustrating a sub-routine for carrying out the calculation of a learned value during the feed-back control.
Figure 16:
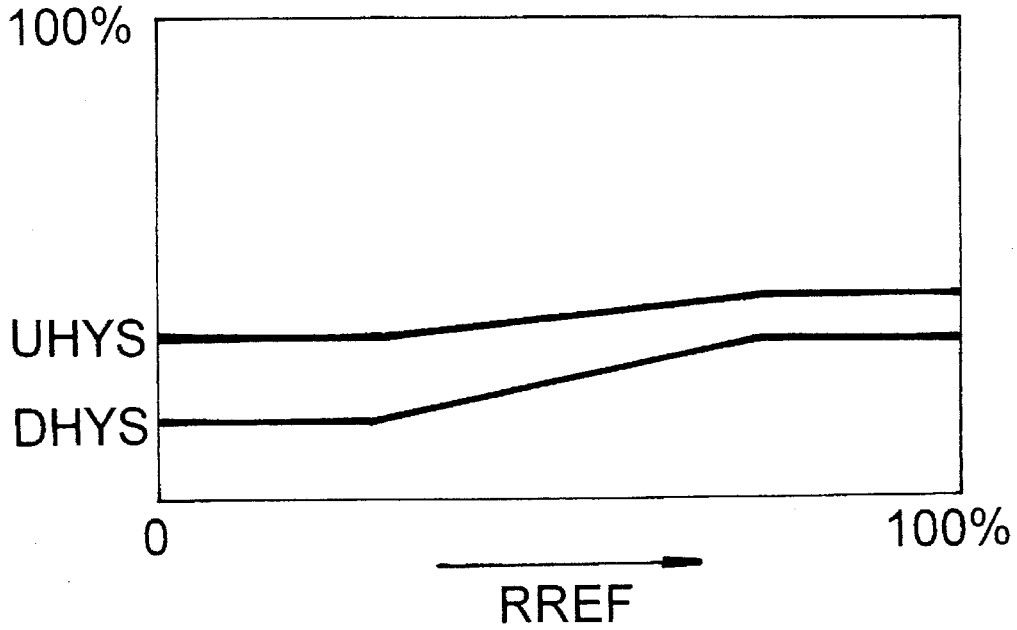
FIG. 16 is a graph illustrating a calculation value for determining a width of hysteresis corresponding to the learned value.

At step S13, the calculation of the learned value RREF is carried out according to a sub-routine shown in FIG. 15. At step S52 as shown in FIG. 15, a width of hysteresis is established by the last learned value RREF. More specifically, a width of hysteresis is establised by an upper limit value UHYS determined by the look-up table in accordance with the learned value RREF and a lower limit value DHYS determined by the look-up table in accordance with the learned value RREF, as shown in FIG. 16. The width of hysteresis determined by the upper and lower values is previously established, e.g., to a small value in accordance with an increase in the learned value RREF.

At step S53, a calculation of adding a temperature correcting term DRTE determined at step S3 (see FIG. 4) in accordance with the engine temperature $T_E$ to the feed-back control value RFB to provide a feed-back control correcting value RFB' (RFB'=RFB+DRTE) is carried out. At steps S54 to S58, the learned value RREF is determined in accordance with whether the feed-back control correcting value RFB' is out of the above-described region. More specifically, when the feed-back control correcting value RFB' exceeds the upper limit value UHYS, a calculation of adding a difference between the feed-back control correcting value RFB' and the upper limit value UHYS to the last learned value RREF to provide a new learned value RREF [(RREF=RREF+(RFB'−UHYS)] is carried out at step S55. When the feed-back control correcting value RFB' is less than the lower limit value DHYS, a calculation of subtracting a difference between the lower limit value DHYS and the feed-back control correcting value RFB' from the last learned value RREF to provide a new learned value RREF [(RREF=RREF+(DHYS−RFB')] is carried out at step S58. Further, when the feed-back control correcting value RFB' is equal to or more than the lower limit value DHYS and equal to or less than the upper limit value UHYS, the last learned value RREF, as it is, is determined as a new learned value at step S59.

Figure 17:
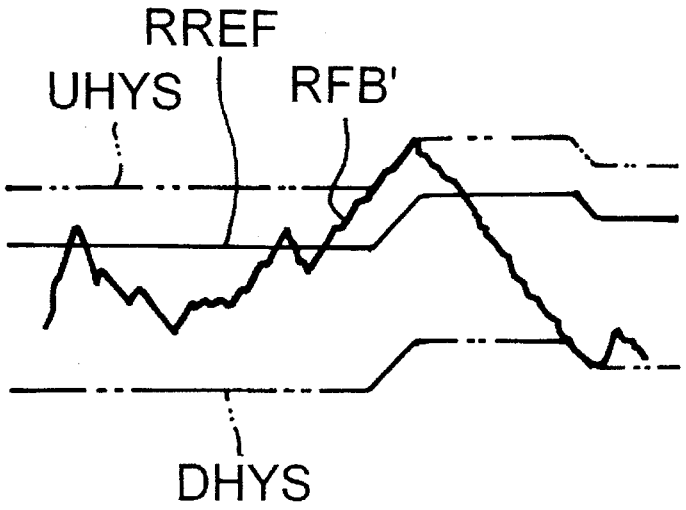
FIG. 17 is a diagram illustrating the relationship between the feed-back control value and the learned value.

By carrying out such sub-routine, a new learned value RREF is determined in accordance with a difference between the feedback control correcting value RFB' including the temperature correcting term DRTE and the lower limit value DHYS or the upper limit value UHYS of a hysteresis range. And as shown in FIG. 17, the learned value RREF becomes a value representative of calorific values of the fuel unless the feed-back control correcting value RFB' including the temperature correcting term DRTE is largely varied, i.e., unless the calorific value of the fuel is varied. Moreover, the temperature correcting term DRTE is lowered as the engine temperature $T_E$ rises, and the feed-back control value RFB is increased in accordance with an increase in the amount of bleed air demanded in the engine attendant on rising of the engine temperature $T_E$. However, by determining a feed-back control correcting value RFB' by adding to the feed-back control value RFB, a temperature correcting term DRTE lowers as the temperature $T_E$ rises. Such feed-back control correcting value RFB' is substantially constant despite a variation in temperature $T_E$, as long as a fuel of a constant calorific value is used. Therefore, the learned value RREF is also substantially constant despite the variation in temperature $T_E$.

Figure 18:
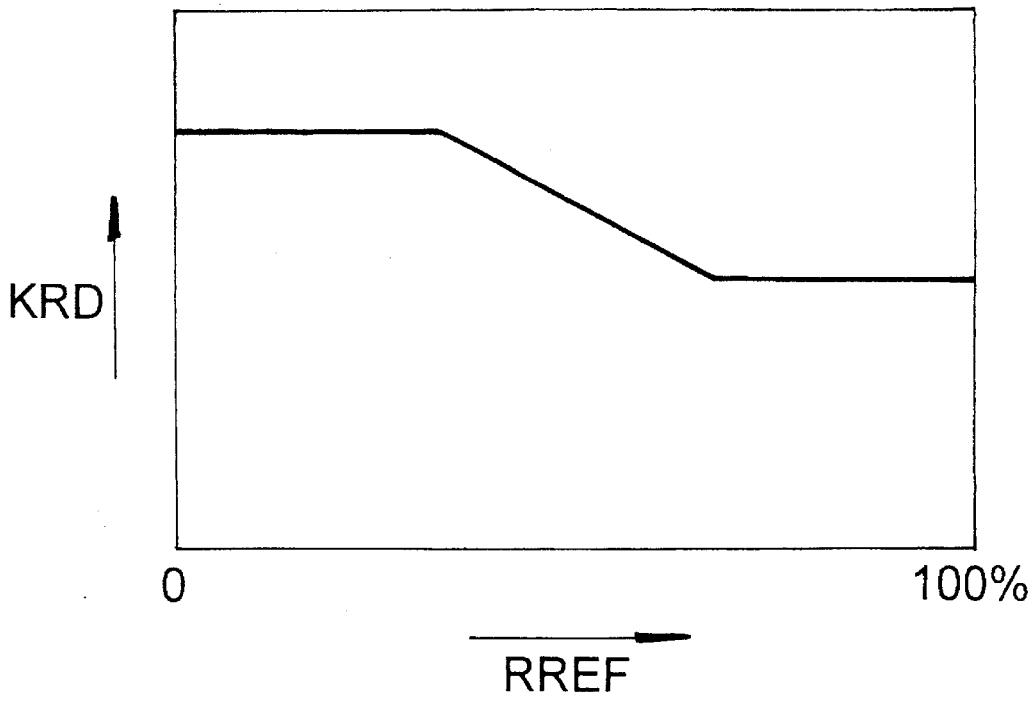
FIG. 18 is a diagram illustrating a variation in correcting term in accordance with the learned value.
Figure 20:
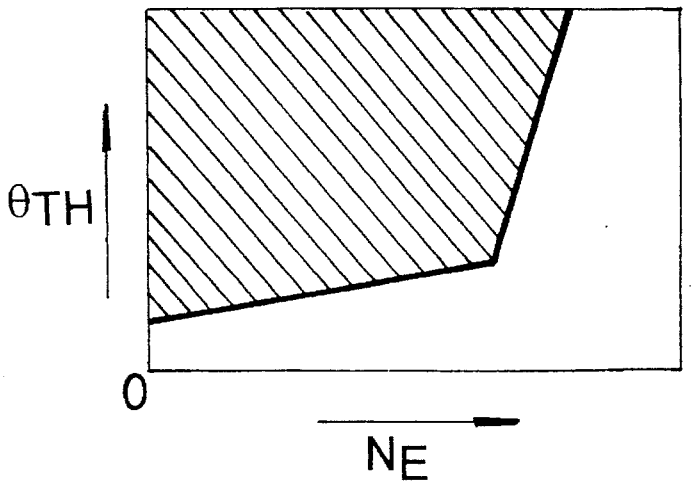
FIG. 20 is a diagram illustrating a map for determining a learning region during the open-loop control.

At step S14, the correcting term KRD dependent upon the learned value RREF is calculated, for example, as shown in FIG. 18. Thus, the correcting term KRD is a smaller value as compared with the case of a lower calorific value of the fuel, when the learned value RREF is high, i.e., when the calorific value of the fuel is high, whereby the amount of bleed air supplied is reduced.

In a procedure for carrying out the open-loop control at steps S21 to S23 shown in FIG. 5, a bypass starter correcting term DRBS is first determined at step S21 in accordance with whether the bypass starter 37 is in its operative state. More specifically, when the bypass starter 37 is in its operative state, the bypass starter correcting term DRBS is determined at a predetermined value. When the bypass starter 37 is in its non-operative state, the bypass starter correcting term DRBS is set at "0".

At step S22, the duty control value RDUTY in the open-loop control is calculated according to a following expression:

$$RDUTY=RREF-(DRBS+DRTE+DRACC+DRWOT)\times KRD$$

wherein DRACC is the acceleration correcting term determined at step S24, when the engine is in its accelerating state; and DRWOT is a WOT correcting term calculated at step S25, when the throttle valve 8 is in its WOT state. More specifically, in the open-loop control, the duty control value RDUTY determined on the basis of the learned value RREF is corrected toward a side in which the air-fuel ratio is enriched, by subtracting, from the learned value RREF, the bypass starter correcting term DRBS determined depending upon the operation of non-operation of the bypass starter 37, the temperature correcting term DRTE determined in accordance with the temperature $T_E$ of the engine, the acceleration correcting term DRACC and the WOT correcting term DRWOT.

Figure 19:
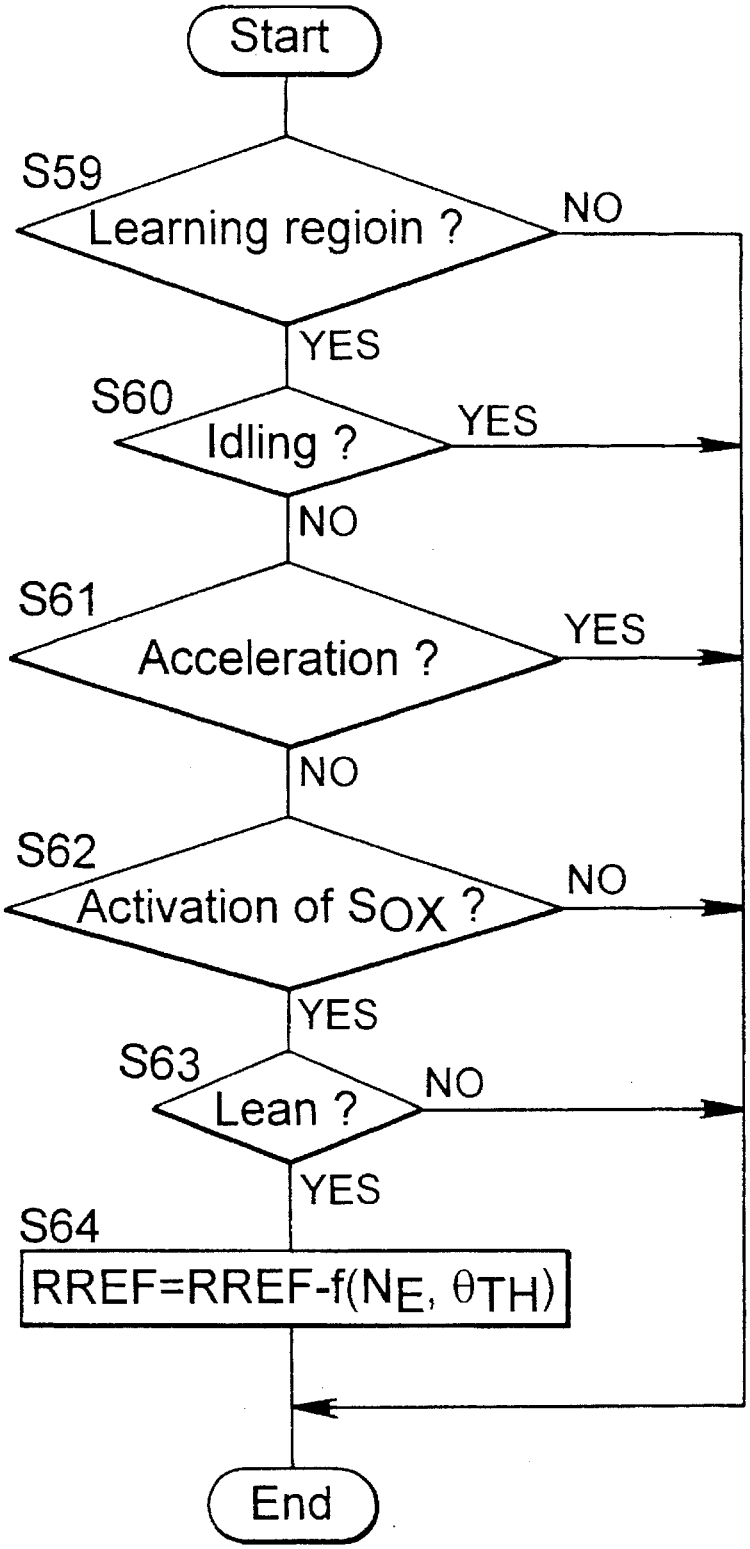
FIG. 19 is a flow chart illustrating a sub-routine for carrying out the calculation of a learned value during an open-loop control.

At step S23, a learned value in the open-loop control is calculated according to a sub-routine shown in FIG. 19. At step S59, it is judged from a map shown in FIG. 20 whether or not the operational condition of the engine is in a learning region at the time of the open-loop control. More specifically, an area shown by oblique lines in FIG. 20 which is determined on the basis of the engine speed $N_E$ and the throttle opening degree $\theta_{TH}$ is in the learning region, the processing is advanced to step S60.

At steps S60 to S63, it is judged whether the engine is in its idling state, whether the engine is in its accelerating state, whether the oxygen sensor $S_{OX}$ has been activated, and whether the output signal from the oxygen sensor $S_{OX}$ indicates a lean condition, respectively. If it is decided that the engine is not in its idling state, that the engine is not in its accelerating state, that the oxygen sensor $S_{OX}$ has been activated, and that the output signal from the oxygen sensor $S_{OX}$ indicates the lean condition, a value resulting from subtraction of a correcting value f ($N_E$, $\theta_{TH}$) determined by the engine speed $N_E$ and the throttle opening degree $\theta_{TH}$ from the last learned value RREF is determined as a new learned value RREF, whereby the learned value RREF is corrected toward the rich side of the air-fuel ratio enriching value.

Referring again to FIG. 5, in the limit check for duty control value RDUTY at steps S15 to S19, when the duty control value RDUTY is smaller than the lower limit value RDL, it is set as RDUTY=RDL at step S16. When the duty control value RDUTY exceeds the upper limit value RDH, it is set as RDUTY=RDH at step S18. When the duty control value RDUTY is equal to or larger than the lower limit value RDL and equal to or smaller than the upper limit value RDH, it is set as RDUTY=RDUTY at step S19. Thus, the duty ratio between the main and slow solenoid valves $V_M$ and $V_S$ is controlled by delivering of the duty control value RDUTY after completion of the limit check.

The duty control of the main and slow solenoid valves $V_M$ and $V_S$ by the electronic control unit ECU ensures that during the feed-back control and when the feed-back control correcting value RFB' corrected by the temperature correcting term DRTE is in a width of hysteresis determined by the predetermined upper and lower limit values UHYS and DHYS dependent upon the learned value RREF, the learned value RREF is determined at a predetermined value within the above-described width of hysteresis. When the learned value RREF deviates from such width of hysteresis, the learned value RREF is determined in such a manner that it is varied by such a deviation. Therefore, by learning the feed-back control value RFB varied in accordance with a variation in calorific value of the fuel, it is possible to provide a learned value RREF which is constant if the calorific value is constant, and to judge the calorific value of the fuel by such learned value RREF.

Moreover, a next feed-back control value RFB is corrected by a correcting term KRD corresponding to the learned value RREF. Therefore, the learned value RREF is reflected to the feed-back control value RFB. Thus, despite the calorific value of the fuel, the air-fuel ratio can be controlled optimally under various operational conditions of the engine to provide stable operability of the engine and a good exhaust gas quality.

In addition, the width of hysteresis for determining the learned value RREF from the feed-back control value RFB is varied as the range of fluctuation in feed-back control value RFB is varied in accordance with a variation in calorific value of the fuel. Therefore, it is possible to promptly determine the learned value RREF in accordance with the variation in calorific value of the fuel and to enhance the responsiveness to the variation in calorific value.

Moreover, the temperature correcting term DRTE is lowered as the engine temperature $T_E$ rises, and the feed-back control correcting value RFB' including such temperature correcting term DRTE is substantially constant irrespective of the variation in temperature $T_E$. The learned value RREF is also substantially constant despite the variation in temperature $T_E$, as long as the fuel of a constant calorific value is used. For this reason, the learned value RREF can be constant irrespective of the temperature $T_E$ at the stoppage of the engine, and as long as the fuel of a constant calorific value is used, the learned value RREF which is reflected to the control value at the start of the engine can be constant, thereby enhancing the operability at the start of the engine.

If the detection value detected by the oxygen sensor $S_{OX}$ indicates a rich condition of air-fuel ratio when the engine is in its slow accelerating state, a next feed-back control value RFB is calculated by relatively small fixed P and I terms $P_3$ and $I_3$, and the feed-back control based on such control value RFB is carried out. Therefore, it is possible to decrease the variation in feed-back control value RFB so as to render the lean-making difficult, thereby avoiding a reduction in acceleration. On the other hand, if the detection value detected by the oxygen sensor $S_{OX}$ indicates a lean condition of air-fuel ratio, a next feed-back control value RFB is calculated by P and I terms $P_1$, $P_2$ and $I_1$, $I_2$ set larger than the P and I terms $P_3$ and $I_3$. The feed-back control based on such control value RFB is carried out. Therefore, it is possible to increase the variation in feed-back control value RFB so as to hasten the enrichment, thereby providing a good acceleration. Moreover, even during slow acceleration, it is possible to enhance the followability in the change of the fuel by carrying out the feed-back control.

The electronic control unit ECU performs the open-loop control when it is decided that the oxygen sensor $S_{OX}$ is in its inactivated state, when the engine is in its accelerating state, when the throttle valve is in its WOT state, when the engine is in its decelerating state, and when the engine is in its idling state as well as when it is decided that the operational condition of the engine is out of the feed-back control region. In the electronic control unit ECU, during the open-loop control, the control value RDUTY determined on the basis of the learned value RREF is corrected by the correcting term DRTE determined in accordance with the engine temperature $T_E$ toward the rich side of the air-fuel ration. Thus, during cold starting and idling of the engine, it is possible to enrich the air-fuel ratio to provide an enhanced operability. Even when the engine is in its accelerating state and the throttle valve is in its WOT state, it is possible to enrich the air-fuel ratio to increase the output power from the engine.

During the open-loop control and when the oxygen sensor $S_{OX}$ is in its activated state; when the engine is in an operational condition other than the idling, accelerating or decelerating operations; and when the detection value detected by the oxygen sensor $S_{OX}$ indicates a lean condition of air-fuel ratio, the learned value RREF is corrected toward the rich side of the air-fuel ratio. Therefore, during the open-loop control which does not follow the variation in calorific value of the fuel, the learned value RREF is corrected toward the rich side, on the basis of the air-fuel ratio being in a lean condition, and thus, it is possible to shorten the period during which the operation of the engine based on the variation in calorific value is in disorder.

Further, during the open-loop control, the control value RDUTY is corrected by the bypass starter correcting term DRBS in accordance with the operation or non-operation of the bypass starter 37, with the change in the switching mode of switch $S_W$ which is in operative association with the bypass starter 37. During the feed-back control, the feed-back control value RFB is set at an initial value including a correcting term DRTE dependent upon the engine temperature and a correcting term DRBS dependent upon the operation or non-operation of the bypass starter 37. Therefore, the main and slow solenoid valves $V_M$ and $V_S$ can be duty-controlled into a proper value despite the operation and non-operation of the bypass starter 37, and the air-fuel ratio can be controlled to a proper value despite the operation or non-operation of the bypass starter 37.

At the hot restart of the engine, the fuel is over-rich in the intake passage 1 between the carburetor C and the engine body E due to the evaporation of the fuel from the carburetor C. However, by bringing the main and slow solenoid valves $V_M$ and $V_S$ into their fully-opened states at the hot restart of the engine, the concentration of the air-fuel mixture supplied to the engine body E is brought to a proper value, thereby making it possible to improve the restartability of the engine.

Although the main solenoid valve $V_M$ is connected to the air control passage 31, and the slow bleed air control passage 32 is connected to the slow solenoid valve $V_S$ in the above-described embodiment, it will be understood that the amount of bleed air supplied through the main bleed air control passage 31 and the slow bleed air control passage 32 can be controlled by a single solenoid valve.

The air-fuel ratio control system for an internal combustion engine according to the present invention is broadly applicable to a motorcycle and the like with an internal combustion engine including a carburetor being mounted therein. Particularly, the air-fuel ratio control system can effectively be applied to an internal combustion engine using a fuel, including a gasoline fuel, containing an alcohol such as ethanol, methanol, an ether such as Methyl Tertiary Butyl Ether (MTBE), Ethyl Tertiary Butyl Ether (ETBE) or the like mixed thereto.

It will be understood that the foregoing description is of a preferred exemplary embodiment of this invention and that the invention is not limited to the specific forms shown. Many modifications can be made in the design and arrangement of the elements, including changes to the control parameters, without departing from the scope of the invention as expressed in the appended claims.

What is claimed is:

1. An air-fuel ratio control system for an internal combustion engine, comprising:

a carburetor including a main fuel system which opens into a venturi portion of an air intake path; a slow fuel system which opens into the intake path at a location downstream from the venturi portion, a main bleed air passage permitting communication between a portion of the intake passage upstream of the venturi portion and the main fuel system; a main bleed air control passage connected at its downstream end to the main fuel system; a slow bleed air passage permitting communication between a portion of the intake passage upstream of the venturi portion and the slow fuel system, and a slow bleed air control passage connected at its downstream end to the slow fuel system;

a valve for controlling the amount of bleed air supplied through the main bleed air control passage and the slow bleed air control passage;

an oxygen sensor for detecting an oxygen component in an exhaust gas flowing through an exhaust passage; and an electronic control unit capable of carrying out a feed-back control for controlling the operation of the valve on the basis of a signal from the oxygen sensor to bring the air-fuel ratio to a theoretical air-fuel ratio, the electronic control unit determining a control value in such a manner that a feed-back control value is learned and stored to provide a learned value which is substantially constant with respect to fuel of a constant calorific value, wherein the stored learned value is reflected to a next control value.

2. An air-fuel ratio control system for an internal combustion engine according to claim 1, wherein the main bleed air passage includes a first stationary jet and the slow bleed air passage includes a second stationary jet, the main bleed air control passage diverges from the main bleed air passage at a location downstream from the first stationary jet, and the slow bleed air control passage diverges from the slow bleed air passage at a location downstream from the second stationary jet.

3. An air-fuel ratio control system for an internal combustion engine according to claim 2, wherein each of the first stationary jet and the second stationary jet has an orifice diameter set at a value of at least 0.3 mm, and each of the main bleed air control passage and the slow bleed air control passage includes a stationary jet which has an orifice diameter set at a value of at most 1.8 mm.

4. An air-fuel ratio control system for an internal combustion engine according to claim 1, wherein the main and slow bleed air control passages are connected to the valve including an inlet port which is put into communication with the atmosphere through an auxiliary air cleaner.

5. An air-fuel ratio control system for an internal combustion engine according to claim 1, wherein the valve is provided in plural and is individually connected to each of the main and slow bleed air control passage and is connected independently to an auxiliary air cleaner.

6. An air-fuel ratio control system for an internal combustion engine according to claim 1, wherein the valve is a solenoid valve and the opening and closing frequency of the valve is set at a value in a range of 5 to 20 Hz.

7. An air-fuel ratio control system for an internal combustion engine according to claim 1, wherein when the feed-back control value is in a width of hysteresis determined by predetermined upper and lower limit values, the electronic control unit determines the learned value at a predetermined point within the width of hysteresis, and when the feed-back control value deviates from the width of hysteresis, the electronic control unit varies the learned value by an amount corresponding to such deviation.

8. An air-fuel ratio control system for an internal combustion engine according to claim 7, wherein the electronic control unit corrects the next control value by a correcting term determined in accordance with the learned value determined during the feed-back control.

9. An air-fuel ratio control system for an internal combustion engine according to claim 7, wherein the electronic control unit varies the width of hysteresis determined by the upper and lower limit values in accordance with the magnitude of the learned value.

10. An air-fuel ratio control system for an internal combustion engine according to claim 1, wherein in a condition in which a detection value detected by the oxygen sensor indicates a rich condition of the air-fuel ratio during a slow acceleration, the electronic control unit reduces the variation in the feed-back control value to a value smaller than a feed-back control value provided during a condition other than the slow acceleration, thereby performing the feed back control.

11. An air-fuel ratio control system for an internal combustion engine according to claim 1, wherein when a detection value detected by the oxygen sensor indicates a lean condition of the air-fuel ratio during a slow acceleration, the electronic control unit increase the variation in the feed-back control value to a value larger than that which is obtained when the detection value indicates a rich condition of the air-fuel ratio, thereby performing the feed-back control.

12. An air-fuel ratio control system for an internal combustion engine according to claim 1, wherein the electronic control unit determines a learned value while taking into account a temperature correcting value to suppress a variation in the learned value caused by a variation in the amount of bleed air required by the engine attendant on a variation in engine temperature during the feed-back control.

13. An air-fuel ratio control system for an internal combustion engine according to claim 1, wherein the electronic control unit is capable of selectively carrying out the feed-back control in a feed-back control region determined by the operational condition of the engine and an open-loop control in a region out of the feed-back control region in a switching manner, and wherein in the open-loop control at the time of starting of the engine, the electronic control unit corrects the control value determined on the basis of the learned value, with a value determined in accordance with the engine temperature, toward a side in which the air-fuel ratio is enriched.

14. An air-fuel ratio control system for an internal combustion engine according to claim 1, wherein the electronic control unit is capable of selectively carrying out the feed-back control in a feed-back control region determined by the operational condition of the engine and an open-loop control in a region out of the feed-back control region in a switching manner, and wherein in the open-loop control, the electronic control unit corrects the learned value toward a side in which the air-fuel ratio is enriched, when the engine is in an operational condition other than idling, accelerating and decelerating operations and when a detection value detected by the oxygen sensor indicates a lean condition of the air-fuel ration.

15. An air-fuel ratio control system for an internal combustion engine according to claim 1, further including a switch whose switching mode is changed in operative association with a bypass starter, wherein the electronic control unit is capable of selectively carrying out the feed-back control in a feed-back control region determined by the operational condition of the engine and an open-loop control in a region out of the feed-back control region in a switching manner, further wherein when in the open-loop control, the electronic control unit corrects the control value in accordance with a change in switching mode of the switch, whereas in the feed-back control, the electronic control unit sets the control value at an initial value which includes a learned value, a correcting term dependent upon an engine temperature and a correcting term dependent upon the operation or non-operation of the bypass starter.

16. An air-fuel ratio control system for an internal combustion engine according to claim 1, wherein the electronic control unit is configured to output a signal to the valve to bring the valve into a fully-opened state at a hot restart of the engine.

17. An air-fuel ratio control system for an internal combustion engine comprising:

a carburetor including a main fuel system which opens into a venturi portion of an intake path; and a slow fuel system which opens into the intake path at a location downstream from the venturi portion; a valve for controlling the amount of bleed air supplied to the main and slow fuel systems, an oxygen sensor configured to detect an oxygen component in an exhaust gas flowing through an exhaust passage; and an electronic control unit arranged so that in carrying out a feed-back control for controlling the operation of the valve on the basis of a signal from the oxygen sensor to bring the air-fuel ratio into a theoretical air-fuel ration, wherein a control value is determined in such a manner that a feed-back control value is learned and stored and the stored learned value is reflected to a next control value, and further wherein the electronic control unit is configured so that when the feed-back control value is in a width of hysteresis determined by predetermined upper and lower limit values, the learned value is determined at a predetermined value within the width of hysteresis, and when the feed-back control value deviates from the width of hysteresis, the learned value is varied by an amount of the deviation to provide a learned value which is substantially constant with respect to fuel of a constant calorific value.

* * * * *